United States Patent [19]

Ege

[11] 4,419,056

[45] Dec. 6, 1983

[54] BACK-UP FOR HIGH VOLTAGE CABLE PRESSURIZING SYSTEM

[75] Inventor: Sigmund Ege, Oslo, Norway

[73] Assignee: International Standard Electric Corporation, New York, N.Y.

[21] Appl. No.: 285,700

[22] Filed: Jul. 22, 1981

[30] Foreign Application Priority Data

Aug. 4, 1980 [NO] Norway ..... 802327

[51] Int. Cl.[3] ..... F04B 23/04; F04B 43/06

[52] U.S. Cl. ..... 417/426; 417/53; 417/393; 92/5 R

[58] Field of Search ..... 417/63, 374, 425, 426, 417/434, 435, 53, 393, 395; 92/5 R; 91/1, 51; 60/571

[56] References Cited

U.S. PATENT DOCUMENTS

| | | | |
|---|---|---|---|
| 1,627,257 | 5/1927 | Stevens | 417/63 |
| 2,817,396 | 12/1957 | Booth | 417/428 |
| 3,388,207 | 6/1968 | Lansch | 137/567 |
| 3,782,863 | 1/1974 | Rupp | 417/393 |
| 4,080,107 | 3/1978 | Ferrentino | 417/273 |
| 4,341,508 | 7/1982 | Rambin, Jr. | 417/426 |

*Primary Examiner*—Carlton R. Croyle
*Assistant Examiner*—Paul F. Neils
*Attorney, Agent, or Firm*—John T. O'Halloran; Alfred C. Hill

[57] ABSTRACT

A back-up system is provided for a pumping plant or a pressure reservoir system used to maintain insulating oil under pressure in high voltage submarine power cables which includes a gas driven membrane pump to insure a small outflow of oil at a rupture point in the power cable to prevent water from penetrating the cable. The proper operation of the membrane pump is insured by introducing degasified oil at the drive side of the pump during the stand-by and test modes of operation of the back-up system.

20 Claims, 19 Drawing Figures

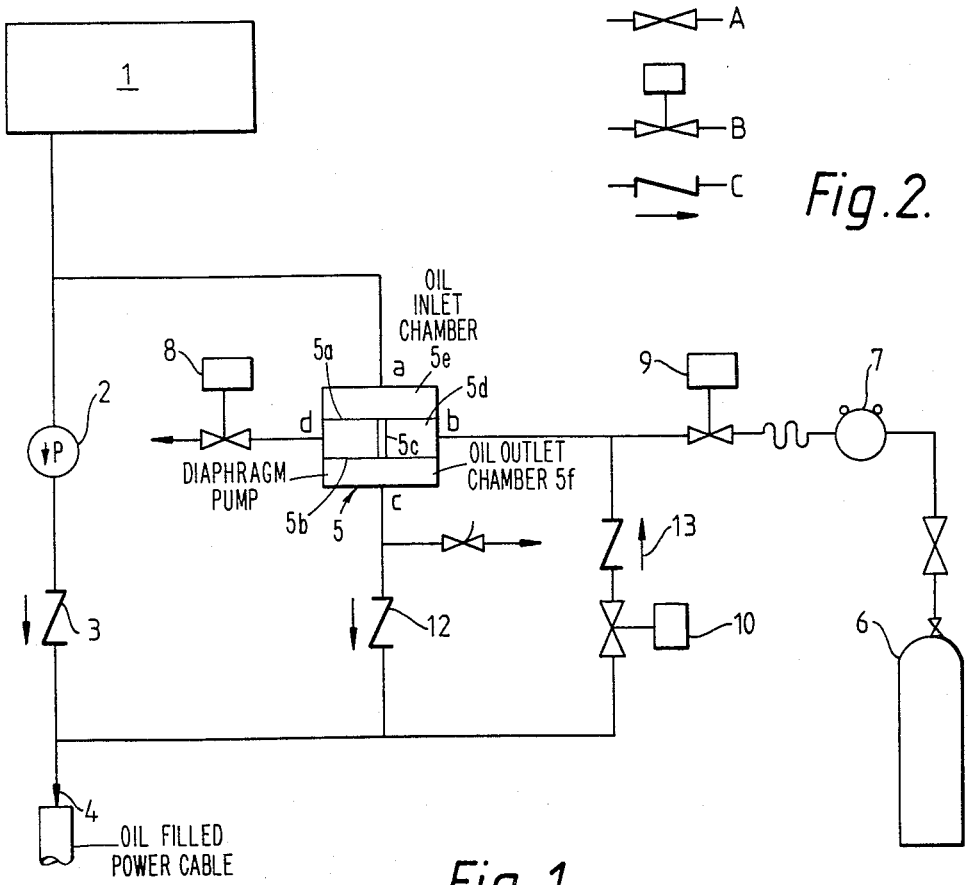
Fig.2.
Fig.1.
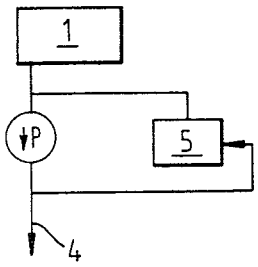
Fig.3.
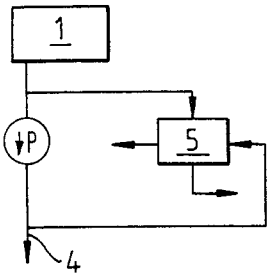
Fig.4.
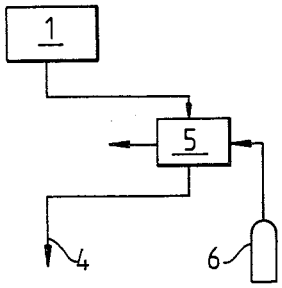
Fig.5.

BACK-UP FOR HIGH VOLTAGE CABLE PRESSURIZING SYSTEM

BACKGROUND OF THE INVENTION

Paper and oil insulated high voltage power cables rely on maintaining the insulating oil under pressure for the proper functioning. In the case of the so-called Pipe Type Cable (three insulated conductors pulled into a common steel pipe) the pressure is normally maintained by a pump drawing oil from an oil tank. The so-called Self Contained Cable is normally kept under pressure by means of static oil reservoirs, although in certain cases a "Pumping Plant" may also be used for this type of cable, particularly in the case of long submarine crossings.

One reason why pumping plants are being used also for Self Contained Submarine Cables is that with this system it is reasonably inexpensive to store a large quantity of oil in case the cable should become ruptured, so that one might prevent water from entering the cable by creating a certain small outflow of oil at the rupture point. The pumping plant is, however, dependent on supply of electricity. The oil reservoir system does not require electricity, but the cost of providing extra oil capacity for a possible cable rupture becomes prohibitive.

For pumping plants, pumps relying on means other than electric motors are known to have been used as a back-up in case of power failure. The back-up pump may have been driven by an air motor, fed either with air or nitrogen stored under high pressure in gas cylinders.

If a suitable system could be developed which could act as a back-up for a pumping plant, such a system ought to be suitable also as a back-up for pressure reservoirs in case a leak should develop in the cable system.

Unfortunately the oil in a Self Contained Cable must be virtually completely free from moisture and gas in order to function properly as an insulation together with the paper. For this reason it is, for instance, not permissible to store such oil under a "blanket" of nitrogen, such as is normally the case for a pipe-type cable pumping plant. For this reason it is known to use so-called "canned" motors to drive the pump in pumping plants for this type of cable. Use of these hermetic motors excludes the need for a rotating seal on the shaft between the motor and the pump. Such a shaftseal is particularly undesirable in the case of a pump which is to stand as a back-up, maybe for several years, before it is called upon to pump oil.

Hermetic motor-pump combinations for air driven motors without a rotating seal do not exist. The pumps which come closest to being "hermetic" are those using the diaphragm or membrane principle. One such pump (marketed by THE WARREN RUPP CO. Mansfield, Ohio under the trade name "Sand Piper" Pump Model No. SAI-A or SB1-A) utilizing two membranes connected by a rod and with a driving gas in contact with the "rod-side" of the two membranes, seems particularly well suited for the purpose. A diaphragm or membrane pump of this type is shown in Operating Instructions, Service Manual and Repair Parts List, issued as Form No. SPL-2/77R by The Warren Rupp Co. and fully disclosed in U.S. Pat. No. 3,782,863, whose disclosure is incorporated herein by reference. The only disadvantage is that it utilizes a membrane which is not made of metal, and therefore, in time, will allow gas and moisture to permeate through the membrane to the cable oil on the other side.

SUMMARY OF THE INVENTION

The main object of the present invention is to overcome the disadvantage of the previously known back-up systems.

The present invention overcomes the disadvantages of known back-up systems by comprising at least one diaphragm pump for pumping cable oil from an oil reservoir to the cable core in case of rupture of the cable sheath causing oil leaks and means for providing that the drive or gas side and the inlet/outlet or suction side of the diaphragm of the pump are subjected to oil at least during the stand-by mode of the pump.

By filling the gas side of the membranes with degasified cable oil, this part of the pump may be maintained under a positive pressure (by means of the same type of pressure reservoir which is used on the cable, or—in the case of a system with pumping plant—from the electric pump which maintains pressure on the cable) until the pump is called upon to provide additional oil to the cable (for instance due to a leak developing) or—in the case of a system with pumping plant—to take over from the electric pump in case of power failure. At this time the oil on the drive side of the membrane will, of course, be replaced by the driving gas, but this condition will only persist until such a time as the leak in the cable has been stopped (or the cable end capped in case of a complete severance) and the cable again can be kept under pressure by the reservoirs. This time period will be fairly short, and moisture and gas will not have time to permeate the membrane to any detrimental degree.

In preparing the pump for "stand-by," vacuum can be pulled on the whole pump (both on the oil side and the gas side of the membranes, including the valve system which makes the rod connecting the two membranes reciprocate). While the pump is still under vacuum it is filled with degasified oil.

One added advantage of the invention is that all the critical parts (in particular the valve system) will be kept in good condition by the oil, so that one may be certain that the pump really will work after having been standing idle, maybe for years.

When the back-up system has performed its function, the pump can again be evacuated and filled with degasified oil. This could conveniently be done at the time that the oil storage tank is being evacuated to be refilled with degasified oil.

According to one embodiment of the invention, which is particularly convenient when the invention is used in connection with a standard pumping plant, it is possible to make a periodic check on the functioning of the "gas-driven" pump without introducing gas into the gas chamber of the pump. This is accomplished by driving the pump by means of oil under pressure supplied by the electric oil pump which normally applies pressure to the cable system. Such a test will first of all prove that the pump really will operate should it be asked to take over the pumping action, and the oil which during stand-by has been sitting in the "oil chamber" of the pump during this time, could be checked for gas content and power factor. With oil on both sides of the membrane it will also be possible to make sensitive tests for possible cracks in the membrane by valving off the two sides of the membrane and monitoring the differential pressure.

The above test could also be made on the back-up system for cables supplied with pressure oil reservoirs, but in this case a separate degasifier and an oil pump will have to be used to perform the test.

According to one embodiment of the invention the back-up system is mounted on a skid containing all the required units such as storage tank, pressure reservoir, pump and gas bottles. Such a back-up may be evacuated and filled with treated oil at the factory, shipped to site and hooked up to the existing pressurizing system either of the reservoir or the pumping plant type. The invention may be used to advantage even in the case where a pump with a metallic membrane is being used, particularly if one should require that the pump should be started up occasionally in order to make sure that it really will pump effectively if called upon to do so. If such a test were to be made with gas rather than oil on the "gas side" of the membrane, it may have serious consequences to the cable if a crack should develop in the membrane, since the gas immediately will enter the cable. With the present invention the danger is eliminated since we have degasified oil on both sides of the membrane. It is true that gas could still come through a broken membrane if the back-up system should ever be called upon to maintain pressure on the cable, but at this time the power will have been shut off the cable, and the introduction of dry nitrogen is therefore not so serious. The gas will not cause an electric breakdown of the cable and may be removed by subsequent treatment of the cable oil prior to reenergizing the cable.

An alternative solution to the problem outlined above is to introduce an additional diaphragm type pump, so that the drive side of the main pump is always operated by degasified oil supplied from the additional pump. The additional pump may be operated during its test and operation mode by pressurized gas or air. While the possibility exists with the additional pump that its diaphragm may rupture and gas or air may be introduced into the oil system on its pump side, the risk of transferring deteriorated oil into the pump side of the main pump is negligible, because the oil on the pump side of the additional pump and on the drive side of the main pump is frequently degasified.

BRIEF DESCRIPTION OF THE DRAWINGS

To give a better understanding of the invention, two examples of its application will be given below, with reference to the accompanying drawings, in which FIG. 1 shows the invention used in conjunction with a pumping plant, FIG. 2 shows a legend of valves, FIGS. 3–5 schematically illustrate three modes of operation of the arrangement of FIG. 1.

DETAILED DESCRIPTION OF THE INVENTION

In FIG. 1 only three elements of a standard pumping plant have been included, namely, an oil storage tank 1, an electrical pump 2 and a check valve 3 which prevents oil from returning to the tank when the pump is not running. The oil ducts of the oil filled cables are connected to the pumping plant at 4.

Figure 6:
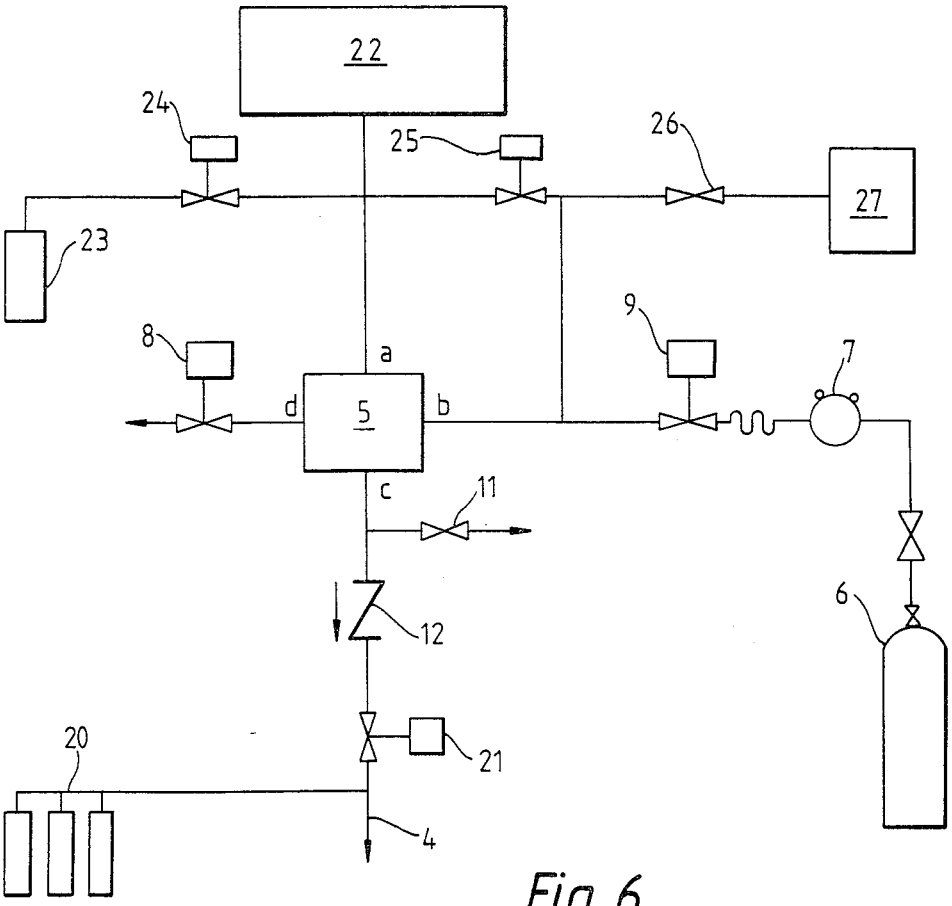
FIG. 6 shows how a back-up may be provided for a cable installation using pressure reservoirs to maintain pressure on the cable, FIGS. 7–10 schematically illustrate four modes of operation of the arrangement of FIG. 6.
Figure 7:
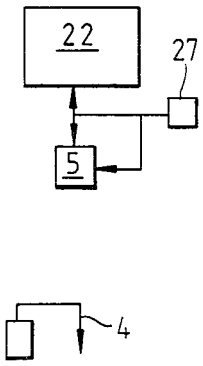

In FIG. 2 is given the legend of the valves shown in FIG. 1 (and also in FIG. 6). A illustrates a manually operated valve, B illustrates an electrically operated valve, and C illustrates a so-called check valve allowing fluid flow in the direction of the arrow only.

Turning now back to FIG. 1, the standard pumping plant has been provided with a back-up system consisting mainly of a membrane pump 5, like that described above under the heading "Background of the Invention" marketed by The Warren Rupp Company under the trade name "Sand Piper" Pump Model No. SA1-A or SB1-A utilizing two membranes 5*a* and 5*b* connected by a rod 5*c* and having a driving gas in contact with the "rod-side" of the two membranes 5*a* and 5*b* in a first chamber 5*d*, a suction input a terminating in a second oil inlet chamber 5*e* and an oil outlet terminating in a third or oil outlet chamber 5*f*. The driving gas is provided by a battery of gas bottles 6 via a pressure reducing valve 7. The inlet and outlet of the "rod-side" or "gas side" of the pump are indicated by b and d, respectively, while a represents the oil suction side and c the oil outlet. The back-up system also includes three electrically operated valves 8, 9 and 10 (these valves are operated by DC current from a stand-by battery), one manually operated valve 11 (apart from those connected directly to the gas bottles 6), and two check valves 12, 13.

The pumping/back-up system has three modes of operation: a stand-by mode, a test mode and a back-up operation mode. In order to give a clear understanding of the various modes of operation, the state of the valves is given in the table below where O=open valve, C=closed valve.

| Mode/Valve No. | 8 | 9 | 10 | 11 |
|---|---|---|---|---|
| Stand-by | C | C | O | C |
| Test | O | C | O | O |
| Operation | O | O | C | C |

In the stand-by mode which is also schematically illustrated in FIG. 3, the membrane pump 5 is kept full of oil on both sides of the membrane. On the suction side a the oil is maintained at a pressure equivalent to the head of oil in the storage tank (this tank being kept under vacuum), while the oil on the "gas side" of the pump will be maintained under the same pressure as that provided by the electrical pump 2 for the cable at 4.

In order to test that the membrane pump 5 is operable, without introducing gas into the pump, all valves but valve 9 are opened. (Valve 11 opened slightly only). Oil will now flow from the tank 1, via the electrical pump 2 and valve 10 to operate the membrane pump 5 because the outlet d is opened by the open valve 8. As a result the pump 5 will pump oil from its a side to its c side, the pumped oil being drained through valve 11. The drained oil from valve 11 as well as oil exhausted through valve 8 should be tested for deteriorations to obtain indication of the condition of the back-up system. The drained oil should, if necessary, be degasified and pumped back to the tank 1. The test mode is also illustrated in FIG. 4.

If the electric power should fail so that the electrical pump 2 is unable to maintain the required pressure in the cable at 4, valve 10 will be switched from open to closed and thereafter valves 8 and 9 from closed to open. In this mode, which is illustrated in FIG. 5, the gas which is supplied from the gas bottle battery 6, will first force the stand-by oil within the pump 5 out through valve 8 while operating the pump 5, and finally operate the pump 5 on gas as intended. By operation of the pump 5, oil will be supplied from the tank 1 to the cable at 4.

When reinstating the stand-by mode after repair of a fault which caused the back-up pump to operate, the system should first be switched to the test mode. The oil tank 1 must not be completely filled with oil, since the space above the oil is to be maintained under vacuum provided by a continuously running vacuum pump (not shown).

In FIG. 6 is illustrated a different embodiment of the invention used in connection with a standard pressure reservoir systems, where pressure reservoirs 20 provide oil for the cable at 4. The elements 5–9, 11, and 12, which are the main parts of the back-up system, are the same as in FIG. 1. A valve 21 is introduced between the back-up system and the pressure reservoir system.

The tank 22 is different from the tank 1 shown in FIG. 1 in that it is maintained completely full of degasified oil. To compensate for variation in volume of the oil in the tank 22 as the temperature varies, a pressure reservoir 23 is connected to the tank 22 by means of a valve 24. Finally, there is provided a valve 25 for interconnecting the two inputs a and b to the membrane pump during the stand-by mode, and a valve 26 to be used in the test mode to ascertain that the membrane pump 5 operates and when filling the tank 22. Oil for initial filling of the tank 22 and for testing of the pump is provided from a source of degasified oil 27. The back-up system may be assembled in the factory where the tank, pump and pipes are evacuated and filled with degasified oil. There are generally four modes of this system: an evacuation/filling mode, a stand-by mode, a test mode and a back-up operation mode. The state of the various valves is given in the table below, and the various modes are illustrated in FIGS. 7–10.

| Mode/Valve No. | 8 | 9 | 11 | 21 | 24 | 25 | 26 |
|---|---|---|---|---|---|---|---|
| Evacuation Filling | C | C | C | C | C | O | O |
| Stand-by | C | C | C | C | O | O | C |
| Test | O | C | O | C | C | C | O |
| Operation | O | O | C | O | C | C | C |

In the evacuation and filling mode (FIG.7) all valves but Nos. 25 and 26 are closed in order to first evacuate the tank 22, pump 5 and associated piping and thereupon fill or pump oil into the system. The tank 22 must be provided with a vacuum pump (not shown) for use prior to and during filling.

Figure 8:
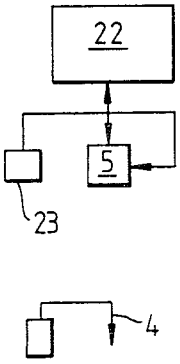
Figure 9:
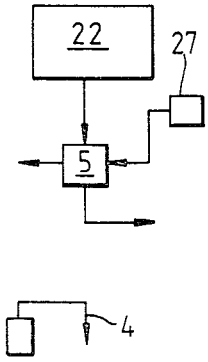

Once the back-up system is ready for transportation to the cable pressure reservoir site, valve 26 should be closed and valve 24 opened, whereby the stand-by mode of FIG. 8 is obtained.

In order to test the membrane pump for proper operation on site without introducing gas into the pump 5, a portable source of degasified oil 27 will have to be brought in and connected to valve 26. The test may be performed by opening valves 26 and 8 (after first having closed valves 21 and 25) so that the supply of degasified oil operates the pump. Oil from the tank 22 is exhausted through valve 11 as in the case of FIG. 1, and the oil on the a/c-side of the pump 5 can be tested for deteriorations. Also the oil drained at pump outlet d should be checked for deteriorations.

Figure 10:
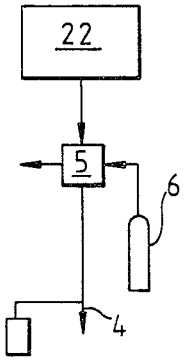

If the cable should start leaking oil as a result of external mechanical damage, or for other reasons, the pressure reservoirs 20 will feed additional oil to the cable at 4, whereby the pressure will gradually decrease. When the pressure approaches a critical low limit, as sensed by a pressure switch (not shown), valve 25 will be closed first, and valves 8 and 9 will open. This will initiate operation of the membrane pump, and valve 21 is finally opened to allow the oil to be pumped from the tank 22 and into the cable at 4. This is illustrated in FIG. 10.

Since vacuum will be created above the oil in the tank 22 as soon as the pump 5 starts pumping, the gas driven pump 5 must be located far enough below the tank 22 to give sufficient head of oil (at least 3–4 feet) to make certain that the pump 5 will prime itself.

According to one embodiment of the invention the suction line is hinged just below the tank, so that the lower portion of this line, with the pump 5, may be rotated 90° (in the middle of the skid) to reduce the space requirement during shipping.

Figure 11:
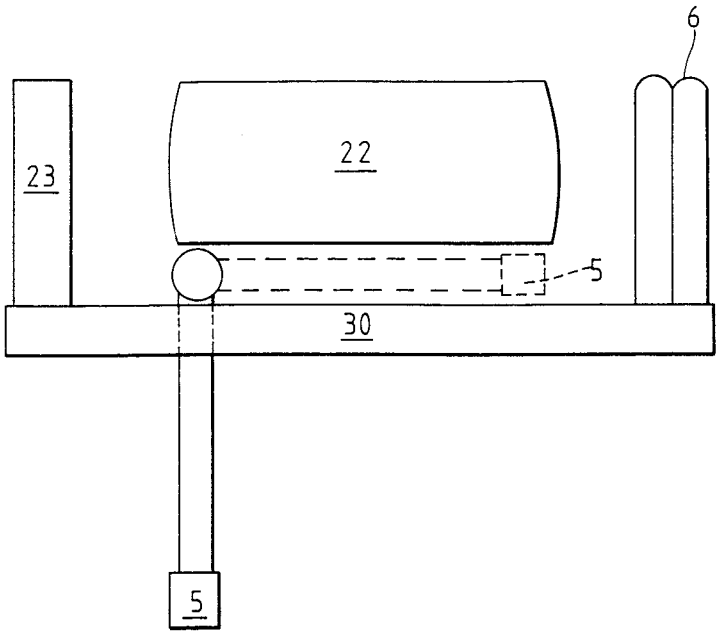
FIG. 11 shows how the back-up system may be mounted on a skid for pre-fabrication and transportation to site, FIG. 12 schematically illustrates a back-up system for a pumping plant, employing two diaphragm pumps.

In FIG. 11 is schematically illustrated the back-up system of FIG. 6 mounted on a skid 30 for pre-fabrication and transportation to site. The membrane pump 5 is shown in two positions, the full line position being the installed position in order to obtain the necessary head of oil, while the broken line position illustrates the transportation position.

Figure 12:
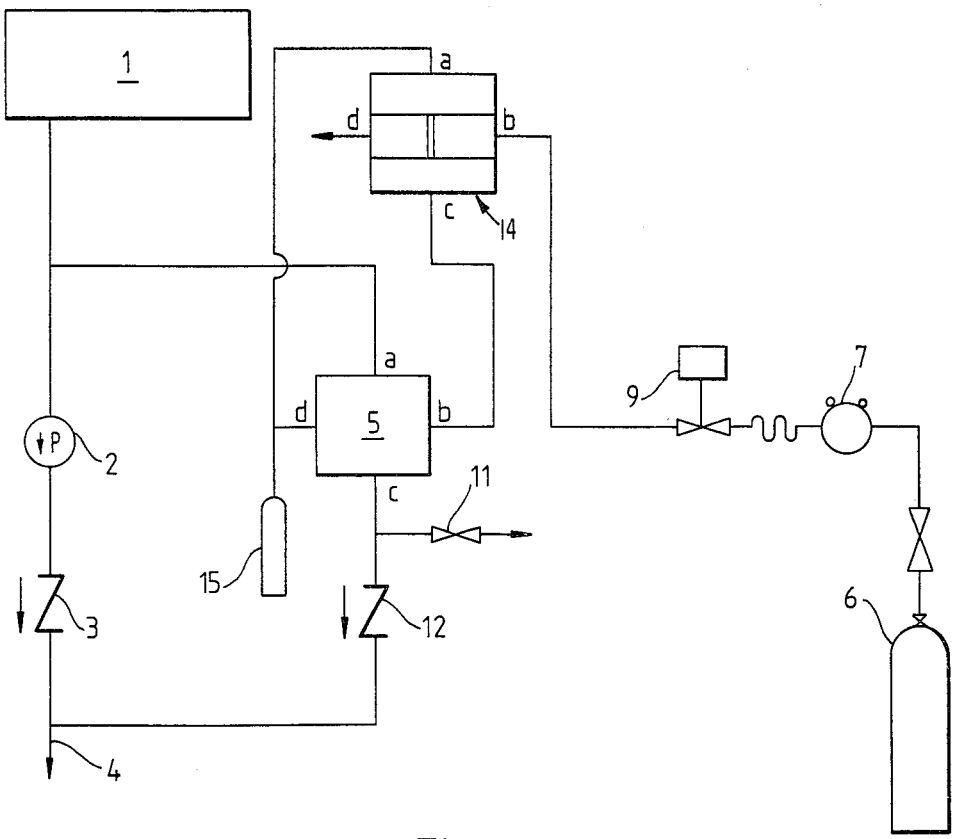

In FIG. 12 is schematically illustrated a back-up system for a pumping plant. This is an alternative to the system illustrated in FIG. 1, in that the drive or gas side (b-d) of the main diaphragm pump 5 is subjected to pressurized cable oil at all times during the stand-by, test and emergency operation modes. This is obtained by letting the pressurized gas or air supplied from the tank or bottle 6 operate a second diaphragm pump 14 identical to the main diaphragm pump 5, i.e. the gas enters at inlet b and is exhausted through outlet d on the drive or gas side of this pump 14, thereby obtaining circulation of degasified cable oil from the a-c side of the pump 14 through the b-d side of the main pump 5. Pressure is maintained in this loop by a pressure tank 15 and the oil may occasionally be circulated via a degasifier (not shown) to degasify the oil and refill the tank 15.

Figure 13:
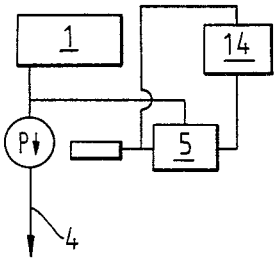
FIGS. 13–15 show the three modes of operation of the arrangement of FIG. 12, FIG. 16 schematically illustrates the two diaphragm pump solution in connection with pressure reservoir plant.
Figure 14:
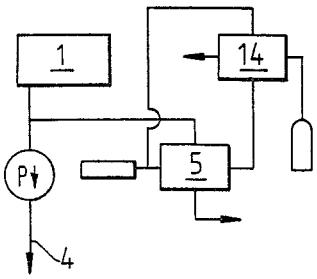

In comparison with the FIG. 1 layout the valves 8, 10 and 13 have been omitted. The stand-by, test and emergency operation modes of FIG. 12 layout is schematically illustrated in FIGS. 13–15.

Figure 16:
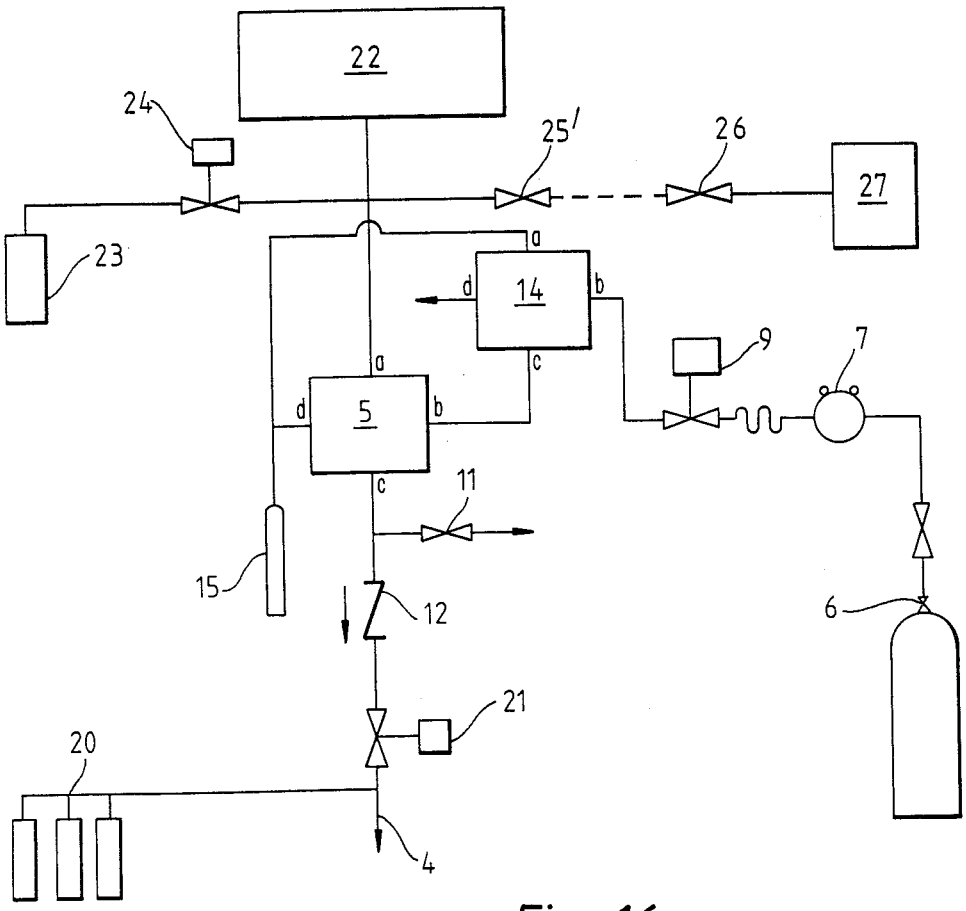

In FIG. 16 is schematically illustrated an alternative back-up system to be used in connection with a pressure reservoir plant described in connection with FIG. 6. As in the system described above in connection with FIG. 12 there is introduced an additional diaphragm pump 14 and a pressure reservoir 15 so that degasified oil may be circulated through the two diaphragm pumps 5 and 14, i.e. from the a-c side of the pump 14 through the b-d side of the pum 15, so that the main pump 5 at all times during the stand-by, test and emergency operation modes is filled with degasified oil. The circulating oil should occasionally be passed through a degasifier (not shown). The source of degasified oil 27 needs only to be connected to the system via the manual valves 25' and 26 when required for filling purposes. It will be seen that the valve 8 has been omitted.

It should be mentioned that the principle of the two series-connected diaphragm pumps may also be used for circulating oil through the degasifiers.

Figure 15:
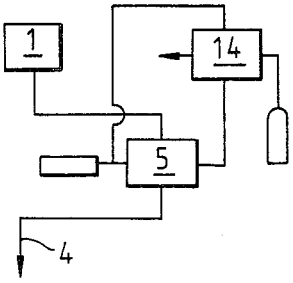
Figure 17:
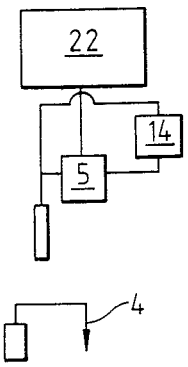
FIGS. 17–19 show three modes of operation of the arrangement of FIG. 16.
Figure 18:
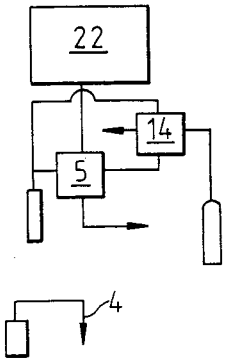
Figure 19:
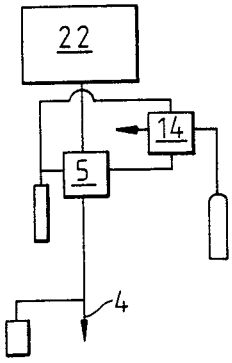

In FIGS. 17–19 are schematically illustrated the stand-by, test and emergency modes of the layout shown in FIG. 15.

A back-up system of the type outlined in FIG. 16 may of course be installed on a skid 30 as outlined in connection with FIG. 11.

Although the invention has been described in connection with particular embodiments, those skilled in the art will perceive modifications not mentioned above that can be made without departing from the spirit of the invention. Therefore, the above description is not intended to define the scope of the present invention, which is delimited solely by the appended claims.

I claim:

1. In a system for pressurizing oil filled power cables including an electrical insulating oil source coupled to said power cables to fill said power cable with said oil and to maintain oil pressure in said power cable, a back-up system to supply said oil to said power cable in case of a rupture of said power cable causing oil leaks comprising:

a reservoir of said oil;

at least one diaphragm-type pump having two spaced diaphragms interconnected by a rod, a gas drive input and a gas drive output coupled to a first chamber disposed between said two diaphragms, a suction input coupled to said oil reservoir and to a second chamber adjacent one of said two diaphragms and an oil output coupled to said power cable and to a third chamber adjacent the other of said two diaphragms, said back-up system having a normal stand-by mode of operation when said power cable is not ruptured, a test mode of operation to enable testing of said diaphragm pump and an operate mode of operation when said rupture occurs; and a first arrangement coupled to said drive input to provide said oil in said first chamber during at least said stand-by mode of operation, said second chamber being coupled to said oil reservoir during all operating modes such that said second chamber and said first chamber have said oil therein simultaneously during at least said stand-by mode of operation.

2. A back-up system according to claim 1, wherein said oil source includes an oil pump coupled to said reservoir, and said first arrangement includes a valve arrangement coupled between said oil pump and said drive input of said one diaphragm-type pump to provide said oil in said first chamber of said one diaphragm-type pump during said stand-by mode of operation.

3. A back-up system according to claim 1, further including a second diaphragm-type pump having two spaced diaphragms interconnected by a rod, a gas drive input coupled to a source of driving gas and to a first chamber of said second diaphragm pump disposed between said two diaphragms, a gas drive output coupled to said first chamber of said second diaphragm-type pump, a suction input coupled to an additional supply of said electrical insulating oil and a second chamber of said second diaphragm-type pump adjacent one of said two diaphragms and an oil output coupled to a third chamber of said second diaphragm pump adjacent the other of said two diaphragms and to said drive input of said one diaphragm-type pump, said second diaphragm-type pump supplying said oil to said drive input of said one diaphragm-type pump during said stand-by, said test and said operating mode of operation.

4. A back-up system according to claim 3, wherein said additional oil supply is a degasified electrical insulating oil supply.

5. A back-up system according to claim 1, wherein said first arrangement includes a first valve arrangement coupled between said reservoir and said drive input of said one diaphragm-type pump to provide said oil in said first chamber of said one diaphragm-type pump during said stand-by mode of operation.

6. A back-up system according to claim 5, further including an oil pressure tank; and a second valve arrangement coupled between said tank and said reservoir to compensate for pressure variations in said reservoir.

7. A back-up system according to claim 1, further including a second arrangement coupled to said drive input of said one diaphragm-type pump to drive said one diaphragm-type pump by pressurized oil during said test mode of operation.

8. A back-up system according to claim 7, wherein said oil source includes an oil pump coupled to said reservoir, and said second arrangement includes a valve arrangement coupled between said oil pump and said drive input of said one diaphragm-type pump and to said oil output of said one diaphragm-type pump.

9. A back-up system according to claim 8, wherein said first arrangement includes a portion of said valve arrangement coupled between said oil pump and said drive input of said one diaphragm-type pump to provide said oil in said first chamber of said one diaphragm-type pump during said stand-by mode of operation.

10. A back-up system according to claim 7, wherein said second arrangement includes a degasified oil supply, and a first valve arrangement coupled between said degasified oil supply and said drive input of said one diaphragm-type pump and said oil output of said one diaphragm-type pump.

11. A back-up system according to claim 10, wherein said first arrangement includes a second valve arrangement coupled between said reservoir and said drive input of said one diaphragm-type pump to provide said oil in said first chamber of said one diaphragm-type pump during said stand-by mode of operation.

12. A back-up system according to claim 1, further including a source of driving gas; and a first valve arrangement coupled to at least said first chamber of said one diaphragm-type pump and said source of driving gas to enable said driving gas to operate said one diaphragm-type pump when said rupture occurs and to simultaneously drive said oil from said first chamber of said one diaphragm-type pump.

13. A back-up system according to claim 12, wherein said oil source includes an oil pump coupled to said reservoir, and said first arrangement includes a second valve arrangement coupled between said oil pump and said drive input of said one diaphragm-type pump to provide said oil in said first chamber of said one diaphragm-type pump during said stand-by mode of operation.

14. A back-up system according to claim 12, wherein said first arrangement includes a second valve arrangement coupled between said reservoir and said drive input of said one diaphragm-type pump to provide said oil in said first chamber of said one diaphragm-type pump during said stand-by mode of operation.

15. A back-up system according to claim 14, further including an oil pressure tank; and a third valve arrangement coupled between said tank and said reservoir to compensate for pressure variations in said reservoir.

16. A back-up system according to claim 12, further including a second arrangement coupled to said drive input of said one diaphragm-type pump to drive said one diaphragm-type pump by pressurized oil during said test mode of operation.

17. A back-up system according to claim 16, wherein said oil source includes an oil pump coupled to said reservoir, and said second arrangement includes a second valve arrangement coupled between said oil pump and said drive input of said one diaphragm-type pump and to said oil output of said one diaphragm-type pump.

18. A back-up system according to claim 17, wherein said first arrangement includes a portion of said second valve arrangement coupled between said oil pump and said drive input of said one diaphragm-type pump to provide said oil in said first chamber of said one diaphragm-type pump during said stand-by mode of operation.

19. A back-up system according to claim 16, wherein said second arrangement includes a degasified oil supply, and a second valve arrangement coupled between said degasified oil supply and said drive input of said one diaphragm-type pump and to said oil output of said one diaphragm-type pump.

20. A back-up system according to claim 19, wherein said first arrangement includes a third valve arrangement coupled between said reservoir and said drive input of said one diaphragm-type pump to provide said oil in said first chamber of said one diaphragm-type pump during said stand-by mode of operation.

* * * * *